United States Patent [19]

Wells

[11] 3,964,057

[45] June 15, 1976

[54] FIRE ALARM AND PROTECTION BOOTH

[75] Inventor: Ronald H. Wells, Baltimore, Md.

[73] Assignee: Fire Alarm Marketing Corporation, Cockeysville, Md.

[22] Filed: May 28, 1975

[21] Appl. No.: 581,434

[52] U.S. Cl. ..... 340/304; 340/274 R; 340/272

[51] Int. Cl.[2] ..... G08B 21/00

[58] Field of Search ..... 340/304, 274, 272

[56] References Cited

UNITED STATES PATENTS

| | | | |
|---|---|---|---|
| 3,886,536 | 5/1975 | Mann | 340/304 |
| 3,886,537 | 5/1975 | Mann et al. | 340/304 |

*Primary Examiner*—John W. Caldwell
*Assistant Examiner*—William M. Wannisky
*Attorney, Agent, or Firm*—Brady, O'Boyle and Gates

[57] ABSTRACT

A fire alarm and protection booth having means therein for signalling an alarm to a fire station and/or police station as well as providing refuge in the case of an emergency. The booth comprises an enclosure having a door and a foot treadle which are coupled to electrical switches adapted to provide input signals to a solid state control circuit which upon the actuation of an alarm switch, sets off an alarm as well as detains the person in the enclosure for a predetermined period. An emergency switch is also included which when actuated locks the door during the time the emergency switch is continuously pressed. In the event that the alarm switch is subsequently actuated, the emergency switch is overridden. The solid state control circuit is further operative to defeat any attempt to compromise the alarm system and thereby render the apparatus fool-proof and tamper-proof.

16 Claims, 6 Drawing Figures

FIG. 1
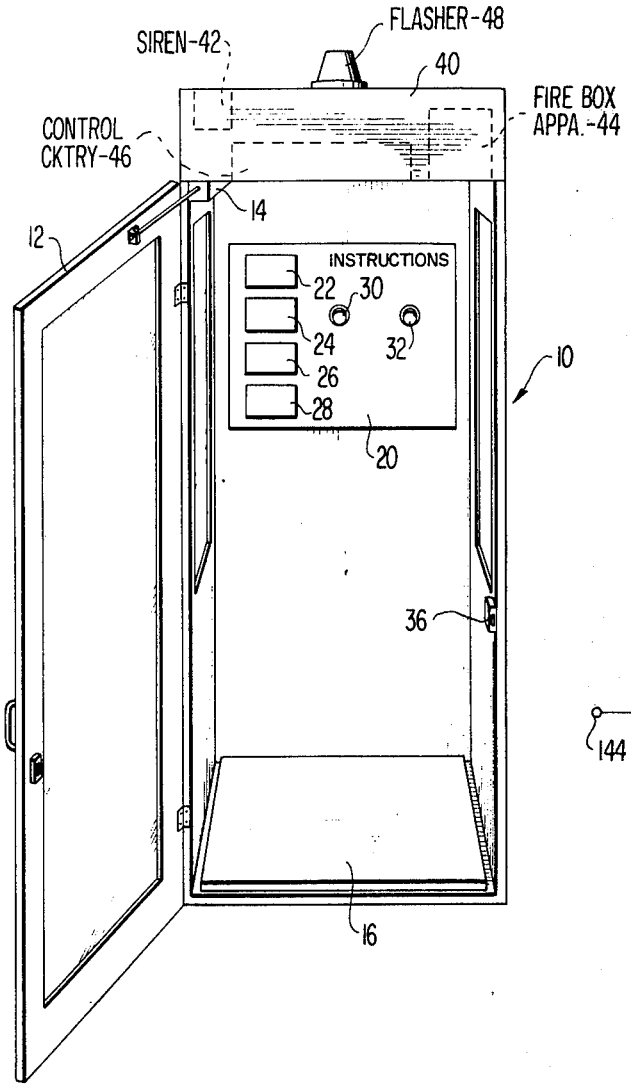
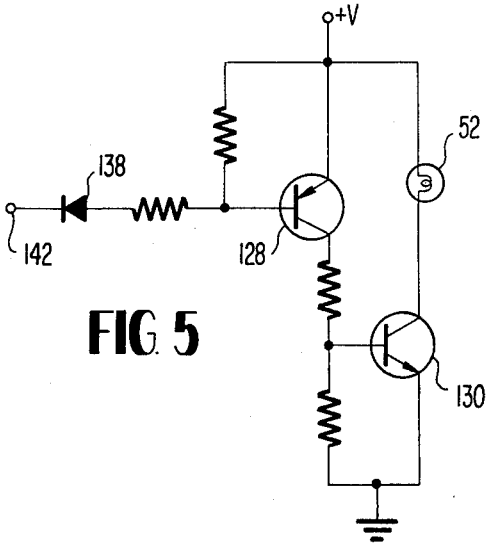
FIG. 5
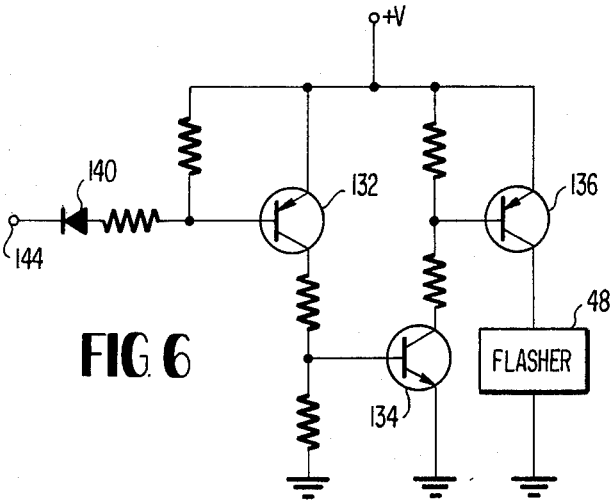
FIG. 6
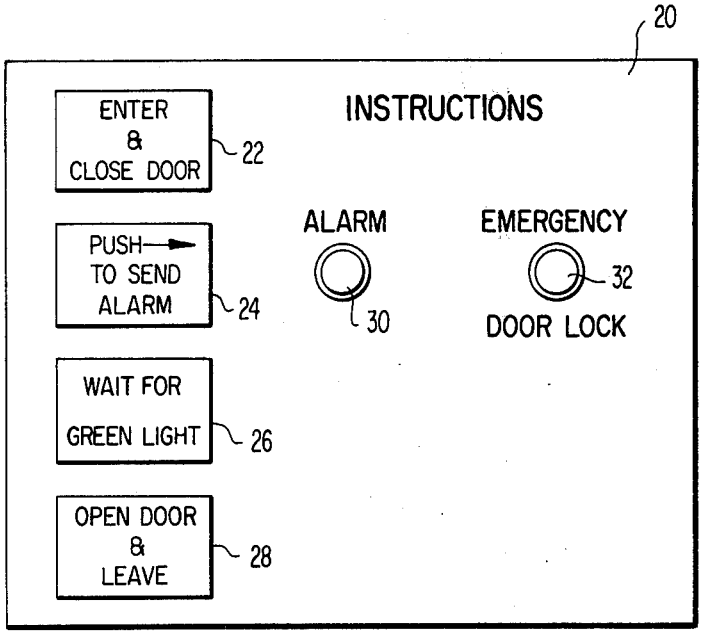
FIG. 2

FIRE ALARM AND PROTECTION BOOTH

CROSS REFERENCE TO RELATED APPLICATION

The present application is related to co-pending application U.S. Ser. No. 482,422, filed on June 24, 1974, entitled "Fire Alarm and Protection Booth", by Vincent Dipaula, Jr. and Joseph L. Casseri, which co-pending application is a continuation of U.S. Ser. No. 379,915, now abandoned.

BACKGROUND OF THE INVENTION

1. Field of the Invention

This invention relates generally to means for signalling an alarm to a central station from a remote station, such as a fire alarm box and more particularly to a fire alarm and protection booth which is adapted to be automatically locked when an alarm is actuated and thereafter automatically unlocked following a predetermined detention period.

2. Description of the Prior Art

Various types of fire alarm apparatus including a booth type enclosure are generally well known in the art. For example, U.S. Pat. No. 790,822, H. T. Gale, et al.; U.S. Pat. No. 1,446,738, J. Dziedzie; U.S. Pat. No. 1,267,165, M. Arnavas; U.S. Pat. No. 2,769,166, H. Seckendorf; and U.S. Pat. No. 934,878, W. J. Bastedo, disclose various types of such apparatus. While such systems presumably operate as intended, they nevertheless have suffered from being susceptible to tampering, whereby false alarms could easily be set off. Currently, the problem of false alarms proposes a particularly agonizing and frustrating situation for both police and fire officials, particularly in urban areas.

SUMMARY

Briefly, the subject invention is directed to an improvement in booth type alarm and protection apparatus which is used for signalling an alarm to a central station as well as providing an emergency refuge. The system includes a booth-type enclosure having a door adapted to be automatically locked for detaining a person inside the enclosure upon his actuating an alarm push-buttom switch. The enclosure additionally includes a floor treadle and an electrical switch operated thereby, as well as an electrical switch operable in accordance with the opening and closing of the door. An electrically operated bolt-type door lock is operable not only to detain the person actuating the alarm, but to actuate a third electrical switch. In addition to the alarm push-button switch, the aforementioned electrical switches are coupled to a control circuit comprised of solid state logic modules which operate in response to the open or closed operating state of the switches to provide the desired operating sequence. The logic control circuit permits actuation of circuit means signalling an alarm only in the event that certain pre-existing conditions are met, and once the alarm push-buttom switch has been momentarily depressed, operates the door lock automatically and maintains the door in a locked condition for a predetermined detention time period, e.g., 3 to 5 minutes, thereafter automatically deactivating the door lock and permitting the person in the booth to leave. In addition, a second push-button switch can be actuated for emergency refuge purposes and is adapted to operate the door lock only as long as the switch means is manually closed. However, in the event that the alarm switch is also pushed, the alarm circuitry overrides the emergency push-button switch and automatic detention is again effected.

BRIEF DESCRIPTION OF THE DRAWINGS

FIG. 1 is a perspective view illustrative of the fire alarm and protection booth, as contemplated by the subject invention;

FIG. 2 is a plan view of the instruction panel located inside the booth shown in FIG. 1 for advising the user of the apparatus;

FIG. 5 is an electrical schematic diagram illustrative of one type of electrical driver circuit; and FIG. 6 is an electrical schematic diagram of a second type of electrical driver circuit.

DESCRIPTION OF THE PREFERRED EMBODIMENT

Figure 3:
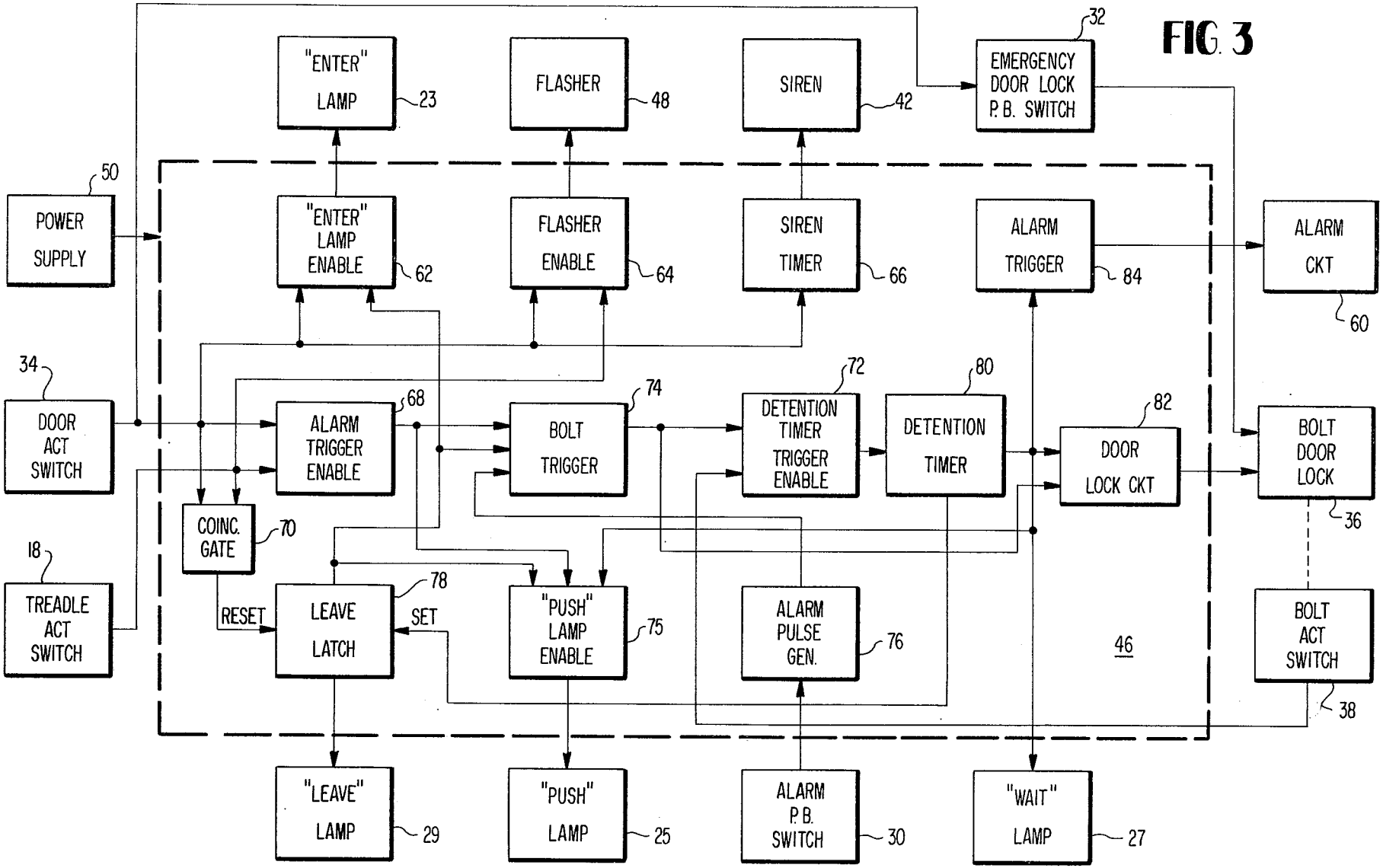
FIG. 3 is a block diagram illustrative of the preferred embodiment of the electrical system utilized for operating the fire alarm and protection booth shown in FIG. 1.

Referring now to the drawings, and more particularly to FIG. 1, reference numeral 10 generally designates an enclosure in the form of a booth having a door 12 which is adapted to be normally closed by means of a closure mechanism 14. A foot treadle 16 is located in the floor portion of the booth interior and is adapted to operate a normally open electrical switch 18 shown in FIGS. 3 and 4 such that when a person enters the booth and stands on the treadle 16, the switch 18 will then be rendered closed. An instruction panel 20 is located on the rear wall of the enclosure 10 and includes four transparent glass instruction panels 22, 24, 26 and 28 which are successively illuminated by means of respective electrical lamps 23, 25, 27 and 29 (FIGS. 3 and 4) located therebehind and which are adapted to provide a person desiring to make use of the present invention the necessary instructions for its operation. The instruction panel 20 additionally includes an "alarm" push-button switch 30 and an "emergency" push-button switch 32 which are respectively adapted to trigger an alarm signal and maintain the door 12 locked for example in an emergency situation without initiating an alarm.

Thus a person desiring to use the booth 10 will find the door 12 closed if in proper working order. On opening the door, the panel 22 is illuminated indicating an instruction to "enter and close door". On entering and closing the door 12 while stepping on the treadle 16, instruction panel 24 will next be illuminated providing the instruction, "push to send alarm", indicating that the alarm push-button 30 should be depressed. After depressing the alarm button 30, instruction panel 26 will next be illuminated, telling the person to "wait for green light". After a predetermined detention time, for example three to five minutes, a green instruction panel 28 will be illuminated telling the person inside the enclosure to "open door and leave".

Figure 4:
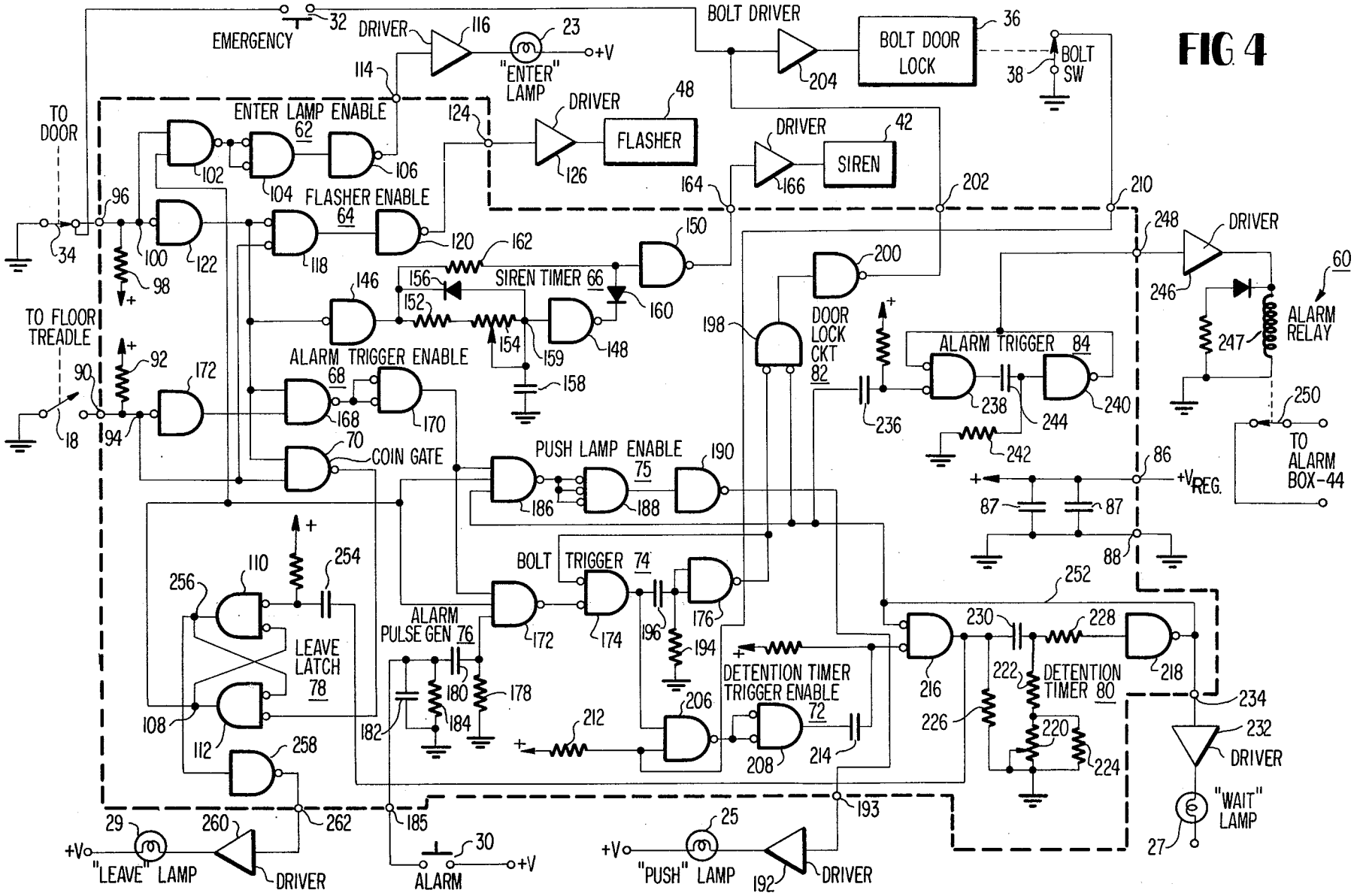
FIG. 4 is an electrical schematic diagram disclosing in detail the solid state logic circuitry contemplated for embodying the block diagram shown in FIG. 3.

In addition to the two push-button switches 30 and 32, as well as the treadle actuated switch 18, the booth 10 also includes a switch 34 shown in FIGS. 3 and 4, which is adapted to be operated by the door 12 and is in a closed operating state when the door 12 is closed. The booth 10 additionally includes an electrically operated bolt-type door lock 36 which is adapted to lock the door and detain the person inside the booth 10 once having signalled an alarm by momentarily depressing the alarm push-button switch 30 or continuously depressing the emergency door lock push-button switch 32. Additionally, the door lock 36 is mechanically coupled to and operates an electrical switch 38 shown in FIGS. 3 and 4, which switch is normally closed when the door lock 36 is unenergized, but opens in response to operation of the door lock.

The booth 10 furthermore includes a closed compartment 40 in the upper portion, which is adapted to house an audible signalling device 42, such as a siren, conventional fire alarm box apparatus 44 and an electronic control circuit section 46, comprising interconnected solid state integrated circuit logic modules as disclosed in FIG. 4, and to be described in detail subsequently. Completing the peripheral apparatus, a flasher unit 48 in the form of a rotating beacon or the like, is mounted on the roof of the booth 10, it being adapted to be energized by the operation of the door actuated switch 34 and/or the treadle actuated switch 18.

Considering now the preferred embodiment of the control circuitry, reference is first made to the block diagram shown in FIG. 3, which is implemented by the solid state circuitry shown in FIG. 4. Reference numeral 50 generally designates a power supply adapted to provide suitable supply voltages required to power integrated circuit binary logic modules and the peripheral devices such as indicator lamps, flasher, siren, etc. The object of the control circuit section 46 is to automatically instruct the user, lock and unlock the door 12 and operate the fire box 44 provided predetermined operating states of the door actuated switch 34, the treadle actuated switch 18, and the bolt actuated switch 38 exist followed by actuation of the alarm push-button switch 30. Accordingly, the door actuated switch 34 is coupled to one input of an "enter" lamp enable circuit 62, a flasher enable circuit 64, a siren timer circuit 66 for the siren 42, to one input of an alarm trigger enabling circuit 68 and to one input of a coincidence logic gate 70. The treadle actuated switch 18 is coupled to the other input of the flasher enable circuit 64, to the other input to the alarm trigger enable circuit 68 and to the other input of the coincicence gate 70. The bolt actuated switch 38 on the other hand is coupled to one input of a detention timer trigger enable circuit 72, which receives as its other input the output from a bolt trigger circuit 74, which in turn has two other inputs respectively from an alarm pulse generator 76, which is energized by the alarm push-button switch 30 and from a bistable "leave" latch circuit 78. The latch circuit 78 is adapted to receive a "reset" input signal from the output of the coincidence gate 70 and a "set" input signal from the output of a detention timer circuit 80 whereupon the circuit changes its operating state each time the "reset" and "set" inputs are applied. The bolt trigger circuit 74 is adapted to initially operate the bolt door lock 36 momentarily through a door lock circuit 82. If the door lock 36 operates properly, its bolt will operate switch 38 and enable the timer trigger enable circuit 72. Once actuated, the door lock 36 is maintained energized through the detention timer circuit 80 since it is operated by the enable circuit 72 in response to the operation of bolt switch 38. The detention timer circuit 80 additionally couples to an alarm trigger circuit 84 which is adapted to operate the alarm circuit 60 which in turn is adapted to operate the fire alarm box 44 shown in FIG. 1. The alarm circuit 60, however, does not operate until the door lock 36 operates properly and switch 38 opens.

Under normal operation, the door 12 is initially closed and the booth 10 is empty. Under these conditions, the treadle switch 18 is open and the door switch 34 is closed. At the same time, the bolt actuated switch 38 is closed, which state is adapted to disable the detention timer trigger enable circuit 72. The siren 42, the flasher 48, the instruction panel lamps 23, 25, 27 and 29, as well as the alarm circuit 60 are deactivated. The system is thus said to be in a quiescent or stand-by state; however, the power supply 50 is operable to provide the necessary power supply potentials.

Assuming further that the booth 10 is in good repair and in operating order, a person desiring to make use of the apparatus must first open the door 12. The door switch 34 will open, whereupon the "enter" lamp 23 will be illuminated by virtue of the enabling circuit 62, receiving inputs from the door switch 34 and a previous "reset" operation of the "leave" latch circuit 78. When the lamp 23 is energized, the instruction panel 22 will be illuminated instructing the person opening the door to "enter and close door". Opening of the door 12 additionally activates the siren timer circuit 66 which causes the siren 42 to operate for a predetermined time period, after which the siren again becomes inoperative. At the same time, opening of the door actuated switch 34 enables the flasher enabling circuit 64, causing the flasher 48 to operate while disabling the alarm trigger enable circuit 68.

After the door 12 is open, the next normal occurrence would be the person entering the booth while stepping on the treadle 16, closing the switch 18. Closing of the treadle-actuated switch 18 continues to enable the flasher enable circuits 64, causing the flasher 48 to continue to operate. At the same time, the alarm trigger enable circuit 68 is partially enabled, i.e. receiving one of two required inputs for operation. Upon closing of the door 12 after the person steps inside the enclosure 10, the door actuated switch 34 again closes. This provides the other enabling input to the alarm trigger enable circuit 68 since the coincidence gate 70, previously coupled a "reset" signal to the bistable "leave" latch circuit 78 when a previous user exited the booth thereby opening treadle switch 18 and closing the door switch 34. This output state will be maintained until a "set" input is subsequently applied. The output of the alarm trigger enable circuit 68 will now enable the "push" lamp enable circuit 75, causing the "push" lamp 25 to illuminate the instruction panel 24, while the "enter" lamp 52 is turned off. The bolt trigger circuit 74 is now partially enabled by the output of the alarm trigger enable circuit 68 and one output of the "leave" latch circuit 78.

If either of the then existing conditions of the door actuated switch 34 and the treadle actuated switch 18 changes, the enabling signals will also be removed from their respective circuits. Otherwise with conditions properly existing, that is, with the person standing on the treadle 16 and the door 12 closed, the bolt trigger circuit 74 is now prepared to receive its third required enabling input for operation. This third input is supplied by the alarm pulse generator 76 upon momentary depression of the alarm push-button switch 30. The pulse generator circuit 76 includes a differentiator which generates a transient signal or pulse which occurs as the push-button switch 30 initially goes from its open position to its closed position. After the initial pulse occurs, the holding of the push-button switch 30 will have no further effect on the system. This type of operation, moreover, insures against compromise of the alarm system by, for example, taping the alarm push-button switch 30 so that it remains permanently closed.

When the bolt trigger circuit 74 is actuated by the person depressing the alarm push-button switch 30 it provides an output signal for a short time period (25 to 50 millisec.) and the bolt door lock 36 is activated through the door lock circuit 82. If the bolt physically moves properly, the bolt switch 38 opens, enabling the detention timer trigger enable circuit 72. If the bolt is restricted in any manner, the bolt switch 38 will not open, and the detention timer trigger enable circuit 72 will not be enabled. However, assuming proper operation, opening of the bolt actuated switch 38 will cause the dentention timer circuit 80 to operate in response to the output of the enabling circuit 72 and then continue to activate the bolt door lock 36 for a predetermined time period (3–5 minutes). Triggering of the detention timer circuit 80 also activates the alarm trigger circuit 84, which causes the alarm circuit 60 to operate and signal an alarm to a remote location, such as the fire house. Additionally, activation of the detention timer circuit 80 will turn off the "push" lamp 25 while turning on the "wait" lamp 27.

After the predetermined detention period, the detention timer circuit 80 times out. The timer circuit then acts to deenergize the bolt door lock 36, turn off the "wait" lamp 27 and now additionally couple a "set" signal to the "leave" latch circuit 78. The "leave" latch circuit 78 switches states providing an output which then operates to light the "leave" lamp 29, while disabling the "push" lamp enable circuit 75 and the bolt trigger circuit 74.

Upon the turn-on of the "leave" lamp 29, the instruction panel 28 is illuminated advising the person to "open the door and leave". Upon opening the door 12 and stepping out of the booth 10, the person's weight would be removed from the treadle 16 and the door 12 would close behind him. When the door is reopened, however, the siren 42 will again sound; however, the latch circuit 78 in the "set" state will now keep the "push"lamp enable circuit 75 and the bolt trigger circuit 74 disabled. Additionally, the "leave" latch circuit 78 disables the "enter"lamp 23. When the door 12 is again closed with no weight on the treadle 16, the door switch 34 and the treadle switch 18 will reset the "leave" latch circuit 78 through the action of the coincidence gate 70, turning off the "leave" lamp 29 and all circuitry except the power supply reverts back to its stand-by state.

When the booth 10 is used for refuge, e.g. personal protection, the previously described sequence of events could take place. However, now all that is necessary is for the person entering the booth 10 to close the door 12 and depress the emergency push-button switch 32, which is adapted to directly operate the door lock 36 as soon as the door closes due to the fact that the push-button switch 32 is connected through the door switch 34. The door would remain locked as long as the emergency push-button switch 32 is held depressed. Since all other conditions are correct for actuating the alarm circuitry, an alarm may also be sent by pressing the alarm push-button switch 30. The detention timer circuit 80 will now override the emergency switch 32 and maintain the locked condition of the door for the predetermined time period, even if the emergency push-button 32 is released.

Referring now to the circuit details as shown in FIG. 4, the control circuit is comprised of a plurality of well known NAND type integrated circuit (IC) logic modules having one or more bubbles (o) designations at its input or a single bubble at its output. This is a convention well known to those skilled in the art, and is indicative of the fact that where the bubble appears on the input side of the module, it takes a "low" binary logic state signal input in order for the module to perform its desired function. A bubble on the output side of the device indicates that when the module performs its function, it provides a "low" binary state signal at the output. Any desired binary logic function can be implemented with this type of module simply by making prescribed connections to the module's external pin connections.

A regulated power supply potential from the power supply 50 shown in FIG. 2 is applied to terminal 86. A current return path, hereinafter referred to as ground, is connected to terminal 88. One side of the treadle actuated switch 18 is coupled to ground, while its other side is coupled to terminal 90. A resistor 92, having one end coupled to a positive (+) supply potential is also coupled to terminal 90. Thus when the treadle actuated switch 18 is open, a "high" binary logic state exists at circuit junction 94, but when the treadle switch 18 is closed by a person standing on the treadle 16 (FIG. 1), a "low" binary logic state exists at junction 94. Likewise, with respect to the door operated switch 34, one side is grounded while its opposite side is connected to terminal 96, to which is coupled one side of a resistor 98, which has its other side also connected to the positive (+) supply potential. Thus when the door is closed, a "low" binary logic state exists at circuit junction 100, while exhibiting a "high" logic state thereat when the door 12 is opened.

The "enter" lamp enable circuit 62 shown in FIG. 3 is comprised of three NAND type IC modules 102, 104 and 106. IC 102 functions as a NAND gate while IC 104 and 106 act as logic inverters. One input of NAND gate 102 is connected to circuit junction 100 while the other input is connected to junction 108 which is one output of the binary "leave" latch circuit 78 comprised of two cross-coupled NAND gates 110 and 112. The output of IC 106 is connected to terminal 114, which couples to a driver circuit 116 and which is illustrated in FIG. 5.

The flasher enable circuit 64 is comprised of a NAND gate 118 and a logic inverter 120, wherein one input of NAND gate 118 is connected to the output of a logic inverter 122 connected to the door switch 34, while its other input is directly connected to the treadle switch 18 through circuit junction 94. The output of IC 120 is connected to terminal 124 which couples to the input of a driver circuit 126, which is shown for example in FIG. 6. The output of the driver circuit is connected to and operates the flasher 48.

The driver circuits shown in FIGS. 5 and 6 are merely shown for purposes of providing a typical example of driver circuits well known to those skilled in the art for operating the peripheral devices of the subject invention which in addition to the lamps 23, 25, 27 and 29 includes the bolt door lock 36 and the alarm circuit 60. Two types are disclosed to illustrate that one driven element, for example the lamp 52, is connected on the power supply side of a transistor circuit configured in a well known connection including transistors 128 and 130, while FIG. 6 illustrates that the driven device, e.g. the flasher 48, being coupled to the ground side of the drive circuit which comprises three transistors 132, 134 and 136. It is to be noted, however, that transistors 132 and 134 are coupled together in a connection identical to FIG. 5. Both driver circuits illustrated in FIGS. 5 and 6 include respective input diodes 138 and 140. These diodes simply act as directional diodes for purposes of coupling a low going input signal applied to input terminals 142 and 144 to transistors 128 and 132 while blocking high-going signals therefrom. As noted, these types of circuits are well known to those skilled in the art and modifications may be made thereto to fit the needs of the user, depending upon the particular application.

Referring now back again in FIG. 4, the siren timer circuit 66 which is adapted to be stopped and reset by the closing of the door 12, is comprised of IC 146, 148 and 150. IC 146 comprises a single input logic signal inverter having its input coupled to the output of door switch logic inverter 122. Between the output of IC 146 and the input of IC 148, is connected a fixed resistor 152, in series with a variable resistor 154 both being shunted by a diode 156. A capacitor 158 is coupled to ground from the common junction 159 between the variable resistor 154 and the input of IC 148. The output of IC 148 is coupled to the input of IC 150 by means of a semiconductor diode 160. The input of IC 150 is also coupled back to the output of IC 146 by means of resistor 162. The output of IC 150 is connected to terminal 164, which connects to the input of the siren driver circuit 166.

The alarm trigger enable circuit 68 is comprised of an IC NAND gate 168 and logic inverter 170. One input of NAND gate 168 is coupled to the output of the door switch logic inverter circuit 122 while the other input of NAND gate 168 is coupled to the output of a treadle switch logic inverter circuit 172, whose input is coupled to the floor treadle switch 18. The output of the inverter 170 is commonly coupled to one input of the "push" lamp enable circuit 75 and to one input of the bolt trigger circuit 74.

The bolt trigger circuit 74 is comprised of three IC modules 172, 174 and 176. IC 172 comprises a NAND gate having three inputs, one of which comes from the output of IC 170 mentioned above. The second input comes from one output (junction 108) of the bistable "leave" latch 78 while the third input comes from the alarm pulse generator circuit 76, which constitutes a passive differentiator circuit comprised primarily of resistor 178 and capacitor 180. Additionally, a parallel combination of a capacitor 182 and resistor 184 are additionally included in the pulse generator circuit 76 for providing a discharge path for the capacitor 180 and as well as providing a filtering effect of a continuously applied positive potential occurring when the alarm push-button switch 30 is continuously depressed.

Prior to the bolt trigger circuit 74 being energized, the "push" lamp 25 must be energized. This is provided by the "push" lamp enabling circuit 75 comprised of three IC modules 186, 188, and 190. The first module 186 is a NAND gate having three inputs wherein one input is coupled to the circuit junction 108 of the "leave" latch circuit 78. The second input is coupled to the output of the alarm trigger enable logic inverter 170, while the third input is coupled to the output of the detention timer circuit 80. IC 188 and 190 comprise a double logic inverter whose output is coupled via terminal 193 to the driver circuit 192 used for exciting the "push" lamp 25.

Returning now briefly to the bolt trigger circuit 74, once the NAND gate 172 is fully enabled, i.e. three "high" signal states are simultaneously present at the three inputs, it provides an output to a second NAND gate 174 which additionally receives a feedback type signal from the third module 176. The output of the NAND gate 174 is fed to the input of the detention timer trigger enable circuit 72 as well as to a second differentiator circuit comprised of resistor 194 and capacitor 196 coupled to IC module 176. The output of the NAND gate 176 then comprises a signal of relatively short duration (25–50 milliseconds) which is fed to one input of a NAND gate 198 forming part of the door lock circuit 82. The other input to NAND gate 198 is supplied from the detention timer circuit 80. It is to be noted that the binary logic output signals from the bolt trigger circuit 74 and the timer circuit 80 when operated are mutually opposite so that NAND gate 198 effectively performs the OR function to operate the door lock 36. The door lock circuit 82 additionally includes a second IC 200 used as an inverter circuit which couples to a terminal 202 and then to the input of a bolt driver circuit 204. The emergency push-button switch 32 is also coupled to the input of the bolt driver circuit 204.

As noted above, the bolt trigger circuit 74 operation of the bolt door lock 36 is only temporary to insure proper operation of the door lock prior to actuating the alarm circuit 60 and causing detention. As noted, the detention timer enable circuit 72 receives an input from the bolt trigger circuit 74 via the output of NAND gate 174. The detention timer enable circuit 72 is comprised of a two input NAND gate 206 and a logic inverter 208. One input to NAND gate 206 is coupled to the output of the bolt trigger NAND gate 174. The other input is coupled to the bolt switch 38 by means of a circuit connection to terminal 210. A resistor 212, coupled to the positive (+) supply potential, is also connected to the second input of NAND gate 206 such that when the bolt trigger circuit 74 is enabled and bolt switch 38 is operated, i.e. opened, two "high" inputs simultaneously appear at NAND gate 206, which produces an actuating signal at the output of IC 208. This signal output is coupled to the detention timer circuit 80 through a coupling capacitor 214 causing it to become operative and take over the door lock energization.

The detention timer circuit 80 is comprised of a NAND gate 216 and logic inverter 218 intercoupled by means of a passive timing circuit comprising a variable resistor 220, fixed resistors 222, 224, 226 and 228, as well as the capacitor 230. The timing circuit is comprised of resistors 220, 222 and 224, in combination with capacitor 230. Once the detention timer circuit 80 is triggered, the output of IC 218 is fed to the "wait" lamp drive circuit 232 via terminal 234, as well as to the NAND gate 198 of the door lock circuit 82 to the input of alarm trigger circuit 84, and to the NAND gate 186 of "push" lamp enable circuit 75, the latter being disabled by the output signal appearing from IC 218 during the detention interval. The door lock circuit 82 is thus continuously activated for maintaining the door lock 36 in a locked condition until the detention timer circuit times out, at which time the door lock is deenergized. The detention timer output additionally triggers the alarm trigger circuit 84 through the coupling capacitor 236. The alarm trigger circuit 84 is comprised of a NAND gate 238 and inverter 240 coupled together by means of a third differentiator circuit comprised of resistor 242 and capacitor 244. The output of NAND gate 238 is differentiated and inverted and then coupled to a relay driver circuit 246 via terminal 248. The alarm circuit 60 is coupled to the output of the driver 246 and comprises an electrical relay including a solenoid 247 and a pair of normally closed switch contacts 250 which are adapted to open when the alarm trigger circuit 84 operates to actuate the fire box apparatus 44 shown in FIG. 1 located in the compartment 40.

It is to be noted that the detention timer circuit includes a feedback connection 252 from the output of IC 218 to the second input of NAND gate 216. This provides operation such that when the timer circuit times out, a signal applied via capacitor 254 coupled from the output of NAND gate 216 to one input of NAND gate 110 in the "leave" latch circuit 78 "sets" the "leave" latch circuit 78 such that an output signal appears at junction 256 which is inverted by means of IC 258 and applied to a "leave" lamp driver circuit 260 by way of terminal 262 for lighting the "leave" lamp 29. The change of state of the "leave" latch 78 further causes the logic state appearing at junction 108 to disable the "push" lamp enable circuit 75, disable the "enter" lamp enable circuit 62 as well as disabling the bolt trigger circuit 74.

When the person in the booth enclosure is signalled to leave by the energization of the "leave" lamp 29 illuminating the instruction panel 28 shown in FIG. 2, the door 34 can be opened and the person leaves, at which time the treadle switch 18 opens. Since the door 12 automatically closes again after the person's exit, the output of IC 122 coupled to the switch 34 goes "high", which is also the logic state of circuit junction 94 coupled to the floor treadle switch 18. This then supplies two "high" inputs to the coincidence NAND gate 70, which operates to provide a "low" "reset" signal to NAND gate 112 of the 37 leave" latch circuit 78, causing the system to go into a stand-by state awaiting subsequent usage, whereupon a new cycle as described above can be initiated.

Having thus disclosed what is at present considered to be the preferred embodiment of the subject invention, we claim:

1. In a control circuit for a booth type enclosure adapted to actuate an alarm circuit for signalling an alarm, for example to the local fire department, as well as providing an emergency refuge, wherein said enclosure (10) includes a door (12) having an electrically operated door lock (36) adapted to detain a person in the enclosure for a predetermined time period after the signalling of the alarm, a floor treadle (16), first switch means (34) actuated by the opening and closing of the door (12), second switch means (18) adapted to be actuated by the person's weight upon the floor treadle (16), third switch means (36) actuated by the door lock, and fourth switch means (30) actuated by the person in the enclosure for initiating an alarm signal, the improvement comprising:

first binary logic circuit means (82) adapted to cause energization of the door lock (36) and having a first and second input signal applied thereto, each of said input signals being adapted to provide a respective control signal for energizing the door lock;

circuit means (76) coupled to said fourth switch (30) means for providing an output signal upon one actuation of said fourth circuit means and thereafter being insensitive to further actuation;

second binary logic circuit means (74) coupled to and responsive to said output signal and at least one enabling signal and being operable to provide said first input signal to said first binary logic circuit means for initially energizing said door lock temporarily to insure operational capability of the door lock and thereby actuating said third switch means (38);

third binary logic circuit means (68) coupled to said first and second switch means (34 and 18) and being responsive to the binary operating states thereof to provide said at least one enabling signal when the door (12) is closed and the foot treadle (18) is actuated;

fourth binary logic circuit means (72) coupled to and responsive to said first input signal and to the binary operating state of said third switch means (38) when actuated to provide a timer circuit actuating signal;

detention timer circuit means (80) coupled to and responsive to said actuating signal and generating said second input signal to said first binary logic circuit means (82) and continuously energizing said door lock for a predetermined time period following said first input signal and thereafter deenergizing said door lock; and alarm trigger circuit means (84) coupled to said detention timer circuit means (80) and being rendered operative thereby when actuated to operate said alarm circuit (60).

2. The control circuit as defined by claim 1 wherein said second binary logic circuit means (74) is responsive to and receives a second enabling signal before becoming operable, and additionally including fifth binary logic circuit means (78) responsive to the binary logic states of said first and second switch means (34 and 18) and being driven to a first of two operating states thereby to provide said second enabling signal when said door was previously closed and said floor treadle not depressed, and being coupled to said detention timer circuit means (80) and responsive to the operation thereof to be driven to a second of said two operating states and thereby applying a disabling signal to said second binary logic circuit means at the end of said predetermined time period.

3. The control circuit as defined by claim 2 wherein said fifth binary logic circuit means (78) comprises a bistable latch circuit having first and second input means and first and second output, and additionally including a binary coincidence logic gate circuit (70) having a pair of inputs coupled to and responsive to the binary operating states of said first and second switch means (34 and 18) and being operable to provide an output signal coupled to said first input means of said latch circuit for causing a switch of operating states of said latch circuit when said door is closed and said floor treadle is not actuated and thereby providing said second enabling signal at said first output means, and wherein said detention timer circuit (80) is coupled to said second input means of said latch circuit, coupling a respective output signal thereto after said predetermined time period for causing another switch of operating states of said latch circuit and thereby providing a disabling signal at said first output means but an enabling signal at said second output means.

4. The control circuit as defined by claim 3 wherein said first switch means (34) is in a first of two binary logic states when said door (12) is closed and wherein said second switch (18) means is in a second of said two binary logic states when said foot treadle (18) is not depressed, and additionally including a binary logic inverter circuit (122) coupling said first switch means to one input of said coincidence gate (70) and circuit means directly connecting said second circuit means to the other input of said coincidence gate.

5. The control circuit as defined by claim 3 and additionally including indicator lamp circuit means (29) coupled to said second output means (256) of said latch circuit and becoming energized in accordance with said enabling signal appearing thereat for providing a visual indication that said predetermined detention time period has expired and the person in the booth (10) is free to "leave".

6. The control circuit as defined by claim 3 and additionally including indicator lamp circuit means (23) and a binary logic enabling circuit (64) coupled thereto, said enabling circuit having a first and second input and wherein said first input is coupled to and is responsive to the binary logic state of said first switch means (34) and said second input is coupled to and is responsive to the binary logic state of said first output means of said latch circuit, said second lamp circuit means thereby being energized when said door is opened following the switching of operating states of said latch circuit by the output signal of said coincidence gate for providing a visual indication to "enter" the booth.

7. The control circuit as defined by claim 3 and additionally including indicator lamp circuit means (25) and a binary logic enabling circuit (75) coupled thereto, said enabling circuit having three inputs respectively coupled to said third binary logic circuit means (68), said bistable latch circuit (78) and said detention timer circuit (80) and being operable to energize said third lamp circuit means when said door is closed and said floor treadle is depressed following switching of operating states of said latch circuit (78) by said coincidence gate (70) for providing an indication to actuate i.e. "push" said fourth switch means 30 but becoming disabled by said detention timer circuit during said predetermined time period.

8. The control circuit as defined by claim 3 and additionally including indicator lamp circuit means (27) coupled to said detention timer circuit (80) and being controlled thereby and energized for said predetermined detention period providing an indication that said door (12) is locked and that a person in the booth should "wait" until instructed to leave.

9. The control circuit as defined by claim 1 wherein said circuit means (76) for providing said output signal comprises a resistance-capacitance differentiator circuit coupled to said fourth switch means (30) comprising a push-button switch and thereby providing a pulse type output signal.

10. The control circuit as defined by claim 1 wherein said first binary logic circuit means (82), said second binary logic means (74), said third binary logic circuit means (68) and said fourth binary logic circuit means (72) are comprised of semiconductor logic modules.

11. The control circuit as defined by claim 10 wherein said logic modules comprise NAND type logic modules.

12. The control circuit as defined by claim 1 and additionally including fifth switch means (32) coupled between said first circuit means (34) and said door lock (36), being adapted to energize the door lock upon being actuated following closure of the door (12) and being operable to continuously maintain the door lock (36) energized as long as said fifth switch means is actuated.

13. The control circuit as defined by claim 1 and additionally including visual alarm signalling means (48) located on said enclosure (10) and enabling circuit means (64) coupled to said visual alarm signalling means, said enabling circuit means receiving a first enabling signal from said first switch means (34) when said door (12) is open and a second enabling signal from said second switch means (18) when actuated by the person's weight on the floor treadle.

14. The control circuit as defined by claim 13 wherein said visual alarm signalling means (48) comprises flasher means.

15. The control circuit as defined by claim 1 and additionally including audio alarm signalling means (42) located on said enclosure (10) and timer circuit means (66) coupled thereto for controlling the operation thereof, said timer circuit means being coupled to said first switch means (34) and receiving an energizing signal therefrom when said door (12) is opened causing said audio alarm signalling device to become operative for a predetermined time as determined by said timer circuit means and thereafter becoming inoperative.

16. The control circuit as defined by claim 15 wherein said audio alarm signalling device comprises a siren.

* * * * *